US009878564B2

(12) United States Patent
Mueller et al.

(10) Patent No.: US 9,878,564 B2
(45) Date of Patent: Jan. 30, 2018

(54) DIGITAL PRINTING MACHINE HAVING A PRINTING BAR FOR INKJET PRINTING

(71) Applicant: HEIDELBERGER DRUCKMASCHINEN AG, Heidelberg (DE)

(72) Inventors: Andreas Mueller, Heidelberg (DE); Burkhard Wolf, Dossenheim (DE); Jochen Renner, Edingen-Neckarhausen (DE); Matthias Zapf, Heidelberg (DE); David Ehrbar, Walldorf (DE); Markus Moehringer, Weinheim (DE); Ralf Steinmetz, Bammental (DE); Manfred Haeussler, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/454,131

(22) Filed: Mar. 9, 2017

(65) Prior Publication Data

US 2017/0259598 A1 Sep. 14, 2017

(30) Foreign Application Priority Data

Mar. 9, 2016 (DE) ..... 10 2016 203 858

(51) Int. Cl.
*B41J 25/304* (2006.01)
*B41J 2/155* (2006.01)

(52) U.S. Cl.
CPC ..... *B41J 25/304* (2013.01); *B41J 2/155* (2013.01); *B41J 2202/15* (2013.01); *B41J 2202/21* (2013.01)

(58) Field of Classification Search
CPC ..... B41J 25/304; B41J 25/308
See application file for complete search history.

(56) References Cited

U.S. PATENT DOCUMENTS 6,299,281 B1 * 10/2001 Shiida ..... B41J 25/308 347/37
6,419,334 B1 7/2002 Akuzawa et al.
2006/0098070 A1 5/2006 Kumagai
2013/0307893 A1 11/2013 Suda et al.

* cited by examiner

*Primary Examiner* — Huan Tran
(74) *Attorney, Agent, or Firm* — Laurence A. Greenberg; Werner H. Stemer; Ralph E. Locher

(57) ABSTRACT

A digital printing machine includes a printing bar for inkjet printing. The printing bar is mounted to be movable into a working position and into a retracted position. An adjustable roll and a spring-mounted roll form a first assembly and are disposed opposite one another. A rail forms a second assembly and is located between the adjustable roll and the spring-mounted roll when the printing bar is in the working position and is not located between the adjustable roll and the spring-mounted roll when the printing bar is in the retracted position. One of the two assemblies is disposed on the printing bar and the other of the two assemblies is separate from the printing bar.

8 Claims, 4 Drawing Sheets

DIGITAL PRINTING MACHINE HAVING A PRINTING BAR FOR INKJET PRINTING

CROSS-REFERENCE TO RELATED APPLICATION

This application claims the priority, under 35 U.S.C. § 119, of German Patent Application DE 10 2016 203 858.3, filed Mar. 9, 2016; the prior application is herewith incorporated by reference in its entirety.

BACKGROUND OF THE INVENTION

Field of the Invention

The present invention relates to a digital printing machine including a printing bar for inkjet printing.

Published U.S. Patent Application US 2013/0307893 A1 discloses a digital printing machine of that type. The disclosed digital printing machine includes a printing bar with bushings and guide bolts disposed separately from the printing bar. When the printing bar is moved to a working position, the bushings are slipped over the guide bolts.

SUMMARY OF THE INVENTION

It is accordingly an object of the invention to provide a digital printing machine having a printing bar for inkjet printing, which overcomes the hereinafore-mentioned disadvantages of the heretofore-known machines of this general type.

With the foregoing and other objects in view there is provided, in accordance with the invention, a digital printing machine comprising a printing bar for inkjet printing. The printing bar is disposed to be movable into a working position and a retracted position. An adjustable roll and a spring-mounted roll form a first assembly and are disposed opposite one another. A rail forms a second assembly and is located between the adjustable roll and the spring-mounted roll when the printing bar is in the working position. The rail is not disposed between the adjustable roll and the spring-mounted roll when the printing bar is in the retracted position. One of the two assemblies is disposed on the printing bar and the other of the two assemblies is disposed separately from the printing bar.

In other words, it is either the rail that is disposed on the printing bar while the two rolls are disposed separately from the printing bar or the two rolls are disposed on the printing bar while the rail is disposed separately from the printing bar. The assembly that is disposed to be separate from the printing bar, in one case the rail and in the other case the two rolls, may be disposed on a frame relative to which the printing bar is movable into the two positions.

The digital printing machine of the invention is advantageous in terms of maintenance work on the printing bar. In the digital printing machine of the invention, the mounting of the printing bar allows the printing bar to be adjusted in a horizontal direction in addition to being movable into the working and retracted positions, a movement that may be a vertical movement. Since the rail is moved out of engagement with the rolls when the printing bar is moved into the retracted position, the rolls cannot interfere with a movement of the printing bar from the retracted position to the maintenance position. When the printing bar is readjusted into the working position, the rail again moves into the roll assembly formed by the rolls.

Additional advantages are that it is possible to adjust the printing bar in a direction perpendicular to the direction of movement of the printing bar due to the adjustable roll and that the spring-mounted roll allows bearing play to be eliminated.

In another development that is advantageous in terms of a form-locking driving of the adjustable roll, the rail is combined with a gear rack and the adjustable roll is combined with a gearwheel. The gearwheel may be in meshing engagement with the gear rack when the printing bar is in the working position and may be disengaged when the printing bar is in the retracted position.

In a further development that is advantageous in terms of a very accurate definition of the working position, the adjustable roll is adjustable towards and away from the spring-mounted roll by using an adjustment device. The adjustment device may be an eccentric.

In an added development that is advantageous in terms of the two rolls running in synchronism, a transmission connects the gearwheel and a further adjustable roll, allowing the two adjustable rolls to be jointly drivable by the gear rack through the gearwheel. The transmission may be a bevel gear drive including bevel gears.

In a concomitant development that is advantageous in terms of eliminating rail play in the working position, the rail is clamped between the adjustable roll and the spring-mounted roll when the printing bar is in the working position.

Other features which are considered as characteristic for the invention are set forth in the appended claims.

Although the invention is illustrated and described herein as embodied in a digital printing machine having a printing bar for inkjet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
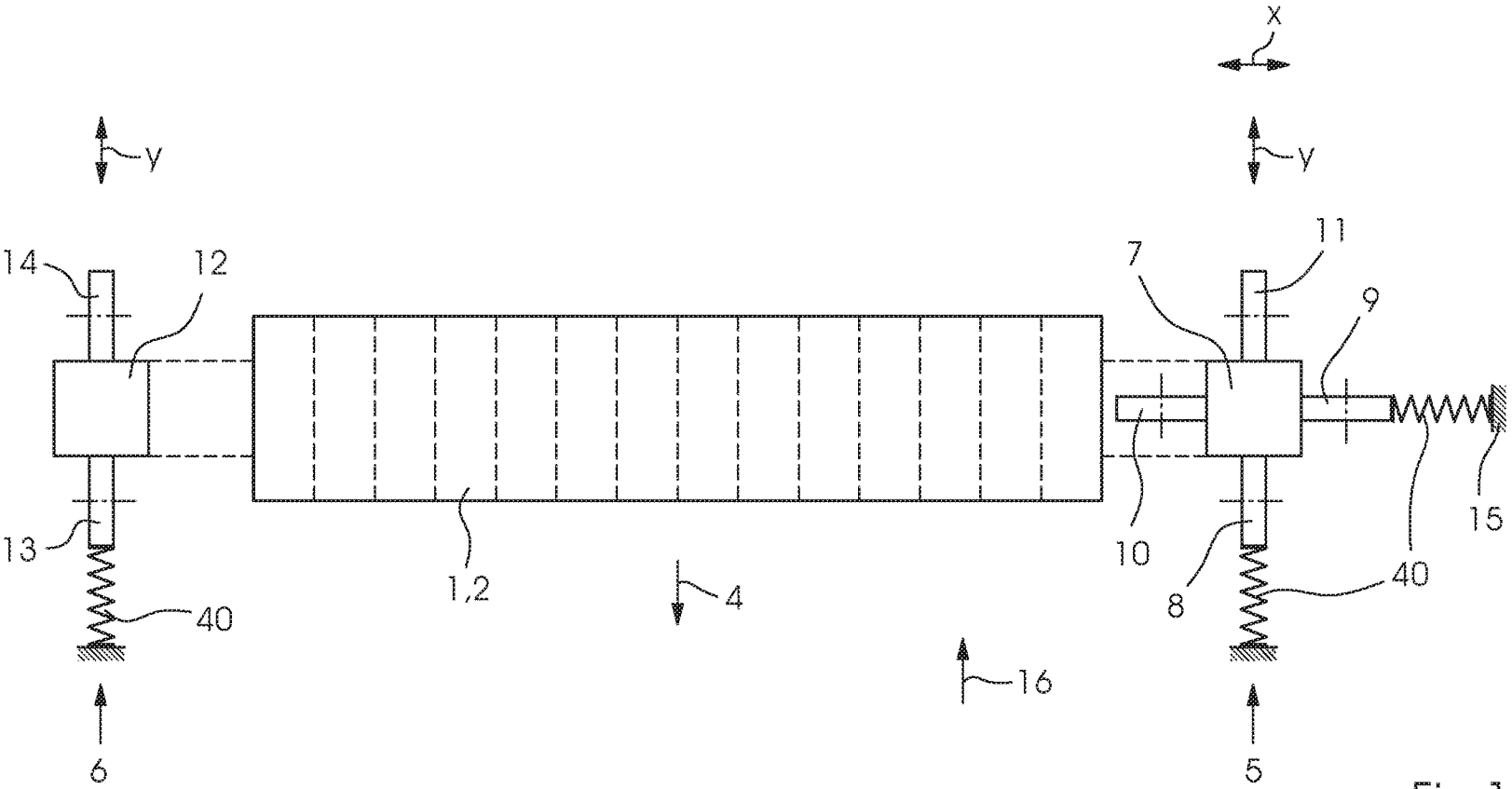
FIG. 1 is a diagrammatic, side-elevational view of a fixed bearing and a movable bearing for positioning a printing bar.

Referring now in detail to the figures of the drawings, in which mutually corresponding elements have the same reference numerals, and first, particularly, to FIG. 1 thereof, there is seen a section of a digital printing machine 1. The section includes a printing bar 2 carrying a row of print heads 3 for inkjet printing. The row of print heads 3 is perpendicular to a direction of transport 4 of a printing substrate. When the printing bar 3 is in its working position (known as the jetting position), the printing bar 3 is mounted in a fixed bearing 5 on one end and in a movable bearing 6 on the other end.

The fixed bearing 5 is formed by a rail 7 and four rolls 8, 9, 10, 11, which clamp the rail 7 between one another when in the working position. The rolls 8 to 11 include two spring-mounted rolls 8, 9 and two adjustable rolls 10, 11. Each one of the spring-mounted rolls 8, 9 is loaded by a respective spring 40 urging the spring-mounted roll against the rail 7 and the latter against one of the adjustable rolls 10, 11. One roll 9 of the spring-mounted rolls 8, 9 and one roll 10 of the adjustable rolls 10, 11 form a first roll pair fixing the rail 7 in a direction X that is perpendicular to the direction of transport 4. The other roll 8 of the spring-mounted rolls 8, 9 and the other roll 11 of the adjustable rolls 10, 11 form a second roll pair fixing the rail 7 in a direction Y parallel to the direction of transport 4.

The movable bearing 6 is formed by a further rail 12 and a third roll pair 13, 14 for fixing the further rail 12 in the Y direction when in the working position. The third roll pair includes a spring-mounted roll 13 and an adjustable roll 14. The two rails 7, 12 have a respective cross section that includes lateral surfaces on which the rolls roll when the printing bar 2 is moved to the working position. The movement of the printing bar 2 into its working position occurs in a direction that is perpendicular to the plane of the image in FIG. 1. Every roll pair is assigned two mutually parallel lateral surfaces of the respective rail 7, 12. The cross-section of the rails 7, 12 is rectangular and the rails 7, 12 are four-cornered rails. The longitudinal direction (i.e. the direction perpendicular to the plane of the drawing in FIG. 1) of the rails 7, 12 extends in a direction that is perpendicular to the longitudinal direction of the printing bar 2 and perpendicular to the direction of transport 4. The rails 7, 12 are fixed to the printing bar 2 and are inserted between the roll pairs when the printing bar 2 is moved into its working position. When the printing bar 2 is not in its working position but in a retracted position relative to the path of printing substrate transport, the rails 7, 12 are not enclosed between the roll pairs but instead are withdrawn from the latter. The movement of the printing bar 2 into the working position and into the retracted position may be driven by a motor and in the process the printing bar 2 may be guided by a guide 47. The retracted position may be an intermediate position into which the printing bar 2 is moved in order to subsequently be moved in a direction X out of the region above the path of printing substrate transport and horizontally into a maintenance position. The rolls 8 to 11, 13, and 14 are respectively supported in a frame 15 relative to which the printing bar 2 is adjustable.

Figure 2:
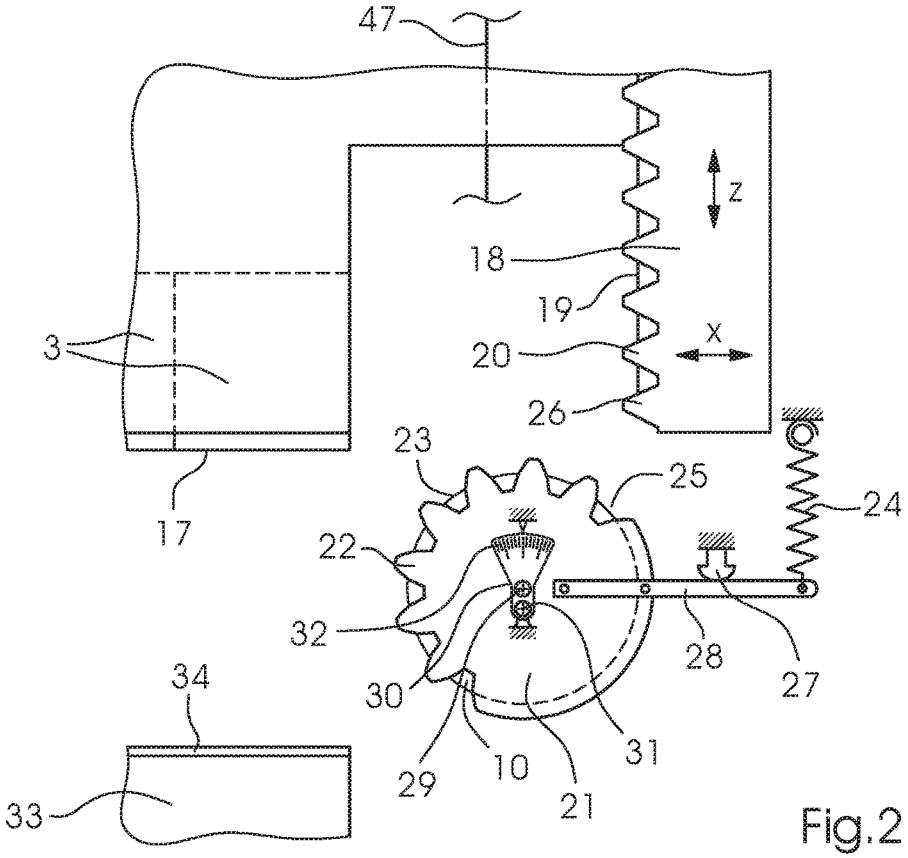
FIG. 2 is an enlarged, fragmentary, end-elevational view of an adjustable roll of the fixed bearing and an accessory gearwheel.

In FIG. 2, the printing bar 2 and the adjustable roll 10 are shown in a viewing direction 16 (seen in FIG. 1). In this representation, the print heads 3, which are disposed in a row on the printing bar 2, and nozzle plates 17 of the print heads 3 for ejecting ink are visible. In addition, the rail 7 is shown to be combined with a gear rack 18. The gear rack 18 and the rail 7 are manufactured either in one piece or in two pieces and subsequently connected to one another. The longitudinal direction of the rail 7 and the longitudinal direction of the gear rack 18 are parallel to a direction Z in which the printing bar 2 is movable into and out of the working position. As described above, a lateral surface of the rail 7 forms a race or guide track 19 for the roll 10. A toothing 20 of the gear rack 18 protrudes beyond the guide track 19 in the direction X. A roll-off line of the toothing 20 of the gear rack 18 may be congruent with the guide track 19 of the rail 7.

A gearwheel 21 has a toothing 22, which may but does not have to extend over the entire circumference of the gearwheel 21. The toothing 22 of the illustrated gearwheel 21 only extends over a part of the circumference. The gearwheel 21 and the roll 10, which are coaxial, may be manufactured either in one piece or in two pieces and subsequently connected to one another for co-rotation. In a radial direction, the toothing 22 of the gearwheel 21 protrudes beyond a circumferential-side rolling surface 23 of the roll 10. A roll-off circle of the toothing 22 of the gearwheel 21 may be congruent with the rolling surface 23 of the roll 10.

A reset spring 24, acting as a device for securing an angle of rotation, returns the gearwheel 21 and the roll 10 to a defined angular position in which a first gap 25 of the toothing 22 of the gearwheel 21 is accurately positioned to receive a first tooth 26 of the toothing 20 of the gear rack 18 when the printing bar 2 is moved into the working position. The "first" gap 25 and the "first" tooth 26 are called "first" because upon the movement of the printing bar 2, they are the first to mesh, i.e. before all other gaps and teeth. In the exemplary embodiment, the reset spring 24 is constructed as a helical tension spring. The defined angular position is defined by a stop 27. A lever 28 is fixed to the gearwheel 21 and hits the stop 27. Instead of the lever 28, a different type of protrusion fixed to or formed on the gearwheel 21 or roll 10 might interact with the stop 27. In the illustrated exemplary embodiment, the lever 28 is used to interact with the stop 27 and simultaneously as a point of application for the reset spring 24. A common axis of rotation 29 of the roll 10 and the gearwheel 21 is mounted in an eccentric 30 disposed to pivot about a pivot joint 31.

The eccentric 30 has a scale for indicating the respective setting of the eccentric 30 and thus the current position of the roll 10. In order to secure the respective setting of the eccentric 30, the latter may be constructed to be self-locking, e.g. as a self-locking eccentric bushing, or it may additionally include a retaining device such as a clamping bolt. The eccentric 30 may be used to adjust the position of the roll 10 and thus of the printing bar 2 in the X direction. This is necessary, for instance, for the printing bar 2 to be correctly positioned relative to a printing substrate transport device 33 and a printing substrate or printing material 34 carried thereon in the X direction. The printing substrate transport device 33 may be an endless conveyor belt or a drum and the printing substrate may be a web or sheet of paper or cardboard.

Figure 3:
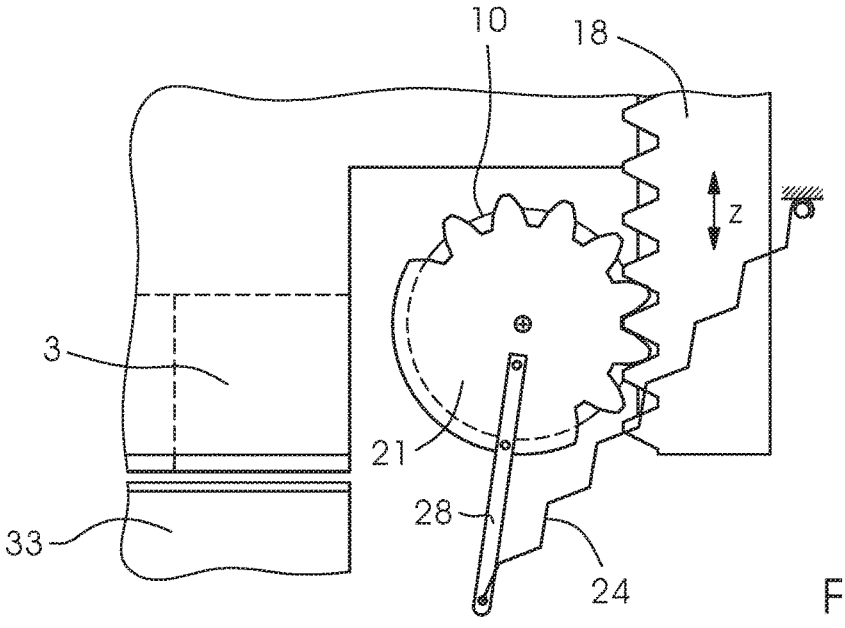
FIG. 3 is a view similar to FIG. 2 showing the gearwheel in engagement with a gear rack of the printing bar.

FIG. 3 illustrates the interaction between the gearwheel 21 and the gear rack 18 when the printing bar 2 is moved into the working position in the Z direction towards the printing substrate transport device 33. For reasons of clarity, the adjustment device (eccentric 30, scale 32) and the stop 27 are not shown. As the gear rack 18 moves downward, it drives the gearwheel 21, inevitably causing the roll 10 to co-rotate. Thus, the rolling surface 23 of the roll 10 rolls off on the guide track 19 without slippage. In every rolling process, irrespective of the direction of rotation of the roll 10, i.e. both when the printing bar 2 is lowered into the working position and when the printing bar 2 is lifted into the retracted position, the same surface point of the rolling surface 23 will meet the same surface point on the guide track 19. This is achieved by ensuring that it is always the first tooth 26 and no other tooth that engages in the first gap 25. Thus, in every movement, manufacturing tolerances of the rolling surface 23 and the guide track 19 have a reproducible effect, allowing these tolerances to be compensated for as the printing bar 2 is aligned. When the printing bar 2 is moved downward into the working position shown in FIG. 3, the gearwheel 21 and the roll rotate in a clockwise direction, tensioning the reset spring 24. When the printing bar 2 is moved upward into the retracted position shown in FIG. 2, the gearwheel 21 and the roll rotate in a counter-clockwise direction, releasing the reset spring 24 down to a residual pre-load. The roll 10 as well as the rolls 11 and 14 are equipped with an accessory gearwheel. In addition to the gear rack 18 for the gearwheel (accessory gearwheel) 21 of the roll 10, the rail 7 of the fixed bearing 5 may have a further gear rack for the accessory gearwheel of the roll 11 and the rail 12 of the movable bearing 6 includes a gear rack for the accessory gearwheel of the roll 14. The roll 10 and the rolls 11 and 14 are supported in an eccentric and are adjustable by using the eccentric, yet not in the X direction like the roll 10, but in the Y direction.

Figure 4:
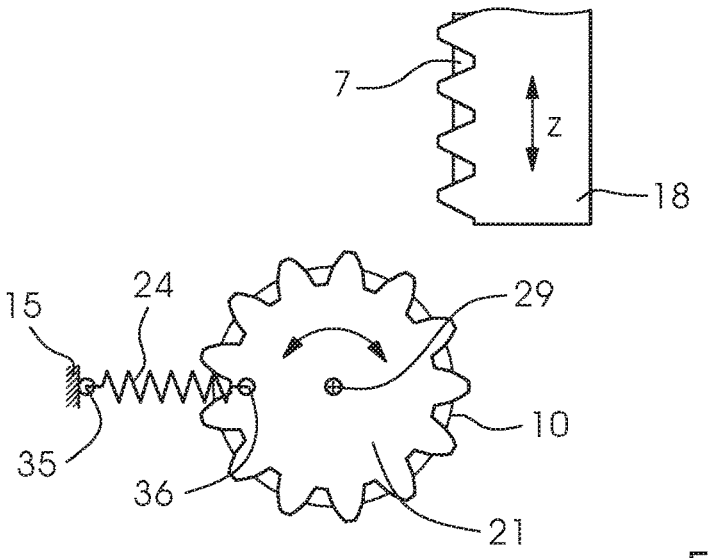
FIG. 4 is a fragmentary, end-elevational view of a device for securing an angle of rotation of the gearwheel, in which the device is embodied as a spring.

Based on the example of the adjustable roll 10, FIG. 4 illustrates a modification in which the lever 28 and the stop 27 are dispensed with. The angular position of the gearwheel 21 required for a correct engagement of the first tooth 26 with the first gap 25 (see FIG. 2) is secured exclusively by the reset spring 24, which is fixed to the frame 15 in a fixed fixing point 35 on one end and to the gearwheel 21 or the roll 10 in an eccentric fixing point 36 on the other end. The fixing points 35, 36 may be pins for hooking in lugs disposed on the ends of the reset spring 24. The reset spring 24 is constructed as a helical tension spring. The angular position required for accurate teeth engagement is pre-defined by the minimum distance between the fixing points 35, 36 and thus by a minimum tension of the reset spring 24.

Figure 5:
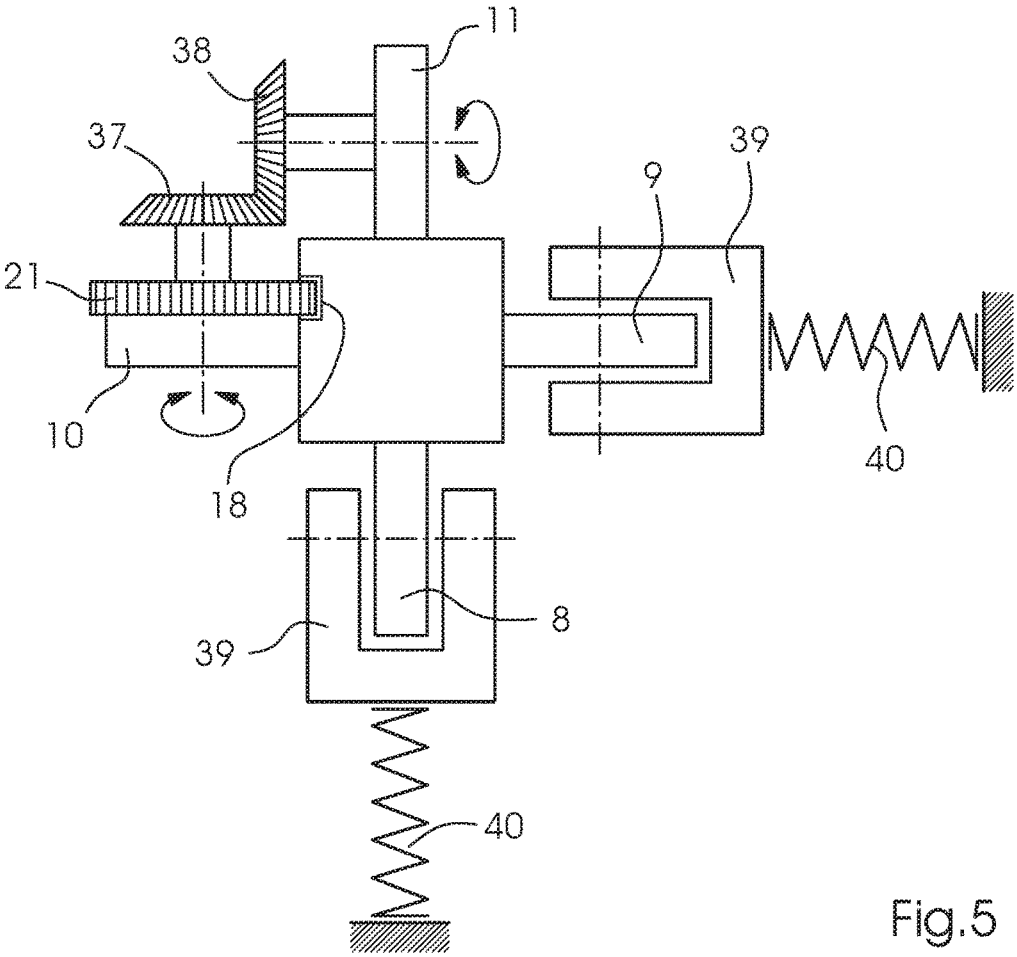
FIG. 5 is a side-elevational view of a bevel gear drive for establishing a driving connection between the roll and another roll of the fixed bearing.

FIG. 5 illustrates a further modification that does not include the gear of the roll 11 and the gear rack temporarily in engagement with the gearwheel. A first bevel gear 37 is disposed to be coaxial and to co-rotate with the roll 10 and the gearwheel 21 and a second bevel gear 38 is disposed to be coaxial and to co-rotate with the roll 11. In this context "disposed to co-rotate" is likewise understood to be a one-piece or assembled construction. The geometric axes of rotation of the two rolls 10, 11 and thus of the two bevel gears 37, 38 are oriented to be perpendicular to one another and the two bevel gears 37, 38 mesh with one another, forming a transmission for transmitting torque from the gearwheel 21 to the roll 11. The two rolls 10, 11, which have the same diameter, are jointly driven by the gear rack 18 through the gearwheel 21 and the transmission (bevel gears 37, 38) ensures that the two rolls 10, 11 run in synchronism because the bevel gears 37, 38 have the same diameter. The gear rack 18 and the gearwheel 21 are thus common drive elements of the rolls 10 and 11. In addition, FIG. 5 shows that the spring-mounted rolls 8, 9 are supported for rotation in linearly adjustable forks 39 loaded by the springs 40.

Figure 6:
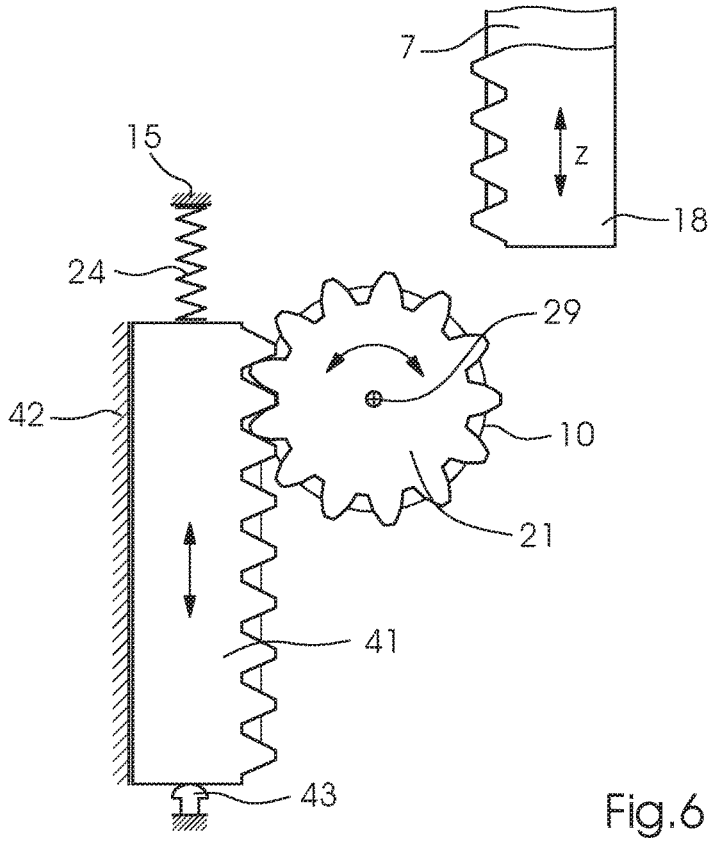
FIG. 6 is a fragmentary, end-elevational view of a device for securing the angle of rotation of the gearwheel, in which the device is embodied as a spring-mounted gear rack.

FIG. 6 illustrates a further modification in which the correct angular position for a meshing engagement between the first tooth 26 and the first gap 35 is ensured by a further gear rack 41 permanently meshing with gearwheel 21, i.e. not only when the printing bar 2 is in the working position but also when it is in the retracted position. The further gear rack 41 is guided in a linear guide 42 and moves in an anti-parallel way relative to the gear rack 18 when the gear rack 18 engages in the gearwheel 21 and drives the latter, which in turn drives the further gear rack 41. The correct angular position is defined by a stop 43 against which the reset spring 24 pushes the further gear rack 41 when the gear rack 18 is disengaged from the gearwheel 21. In this exemplary embodiment, the reset spring 24 is a compression spring supported on the frame 15 on one end and on the further gear rack 41 on the other end. If the further gear rack 41 has a suitable length, the roll 10 may make multiple revolutions while continuously rolling on the rail 7, for instance while the printing bar 2 is moved from the retraced position into the working position with the rail 7. When the printing bar 2 is moved from the retracted position into the working position, the reset spring 24 is tensioned. In the reverse case, i.e. when the printing bar 2 is moved from the working position into the retracted position, the reset spring 24 is released down to a residual pre-load.

Figure 7:
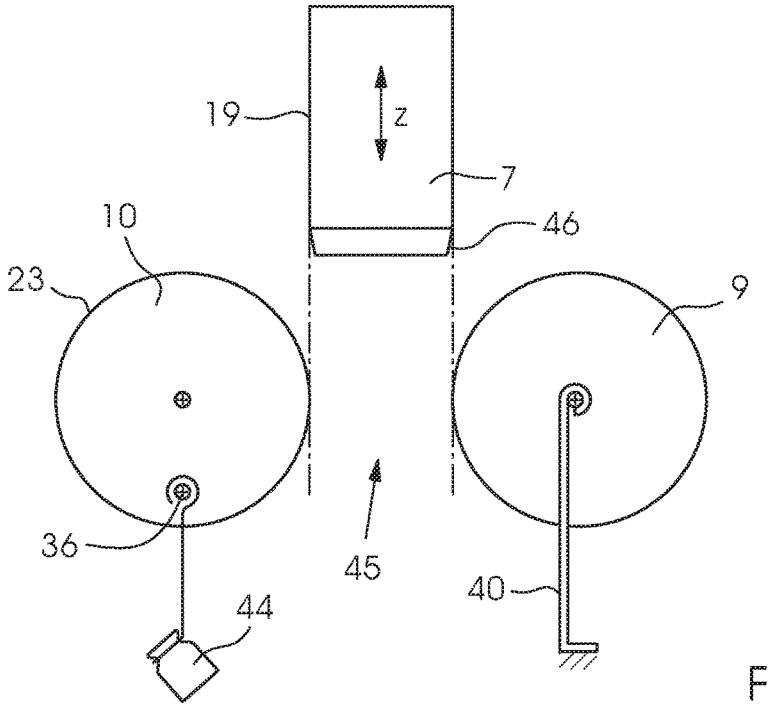
FIG. 7 is an end-elevational view of a device for securing the angle of rotation of the gearwheel, in which the device is embodied as a weight.

FIG. 7 illustrates a further modification that does not include any toothed elements. In this case, the spring 40 is a leaf spring or a leaf spring package generating a clamping force for the clamping rail 7 between the rolls 9, 10. The clamping force is strong enough for the adjustable roll 10 to roll on the rail 7 virtually without slip. While the exemplary embodiments described above rely on a form-locking engagement of meshing toothed elements to ensure that the rolling surface 23 rolls off on the guide track 19 in a reproducibly congruent way, the exemplary embodiment of FIG. 7 relies on frictional engagement. An adjustment mass 44, having a weight which keeps the roll 10 in the illustrated angular position as long as the roll 10 is not in rolling contact with the rail 7, is suspended in an eccentric fixing point 36 on the roll 10. A movement of the printing bar 2 into the working position causes the rail 7 to enter a space or clearance 45 between the rolls 9, 10. An insertion bevel or inclined insertion surface or inclined insertion plane 46 formed on the end of the rail 7 pushes the spring-loaded roll 9 out of the adjustment path of the rail 7 and away from the adjustable roll 10 (to the right in FIG. 10) against the action of the spring 40.

In the exemplary embodiments shown in FIGS. 3 to 7, all adjustable rolls 10, 11, and 14 are supported in an eccentric 30 as shown by way of example with the roll 10 in FIG. 2, even though this is not shown in the drawings.

In a modification that is not shown in the figures, the eccentric 30 is replaced by different adjustment devices such as adjustment screws having differential threads which may be used to fine-adjust the axes of rotation of the adjustable rolls 10, 11 and 14.

In all of the exemplary embodiments, the rail 7 of the fixed bearing 5 moves into the clearance 45 (see FIG. 7) between the four rolls 8 to 11 and the rail 12 of the movable bearing 6 enters into the clearance between the rolls 13 and 14 as the printing bar 2 is moved from the retracted position into the working position. When the printing bar 7 is in the retracted position, the two rails 7, 12 are outside the two clearances.

The invention claimed is:

1. A digital printing machine, comprising:

a printing bar for inkjet printing, said printing bar being mounted for movement into a working position and a retracted position;

an adjustable roll and a spring-mounted roll being disposed opposite one another and forming a first assembly;

a rail forming a second assembly;

said rail being located between said adjustable roll and said spring-mounted roll when said printing bar is in said working position;

said rail not being located between said adjustable roll and said spring-mounted roll when said printing bar is in said retracted position; and one of said assemblies being disposed on said printing bar and the other of said assemblies being separate from said printing bar.

2. The digital printing machine according to claim 1, which further comprises a gear rack combined with said rail and a gearwheel combined with said adjustable roll.

3. The digital printing machine according to claim 2, wherein said gearwheel is in meshing engagement with said gear rack when said printing bar is in said working position, and said gearwheel is disengaged from said gear rack when said printing bar is in said retracted position.

4. The digital printing machine according to claim 1, which further comprises an adjustment device for adjusting said adjustable roll towards and away from said spring-mounted roll.

5. The digital printing machine according to claim 4, wherein said adjustment device is an eccentric.

6. The digital printing machine according to claim 2, which further comprises:

a further adjustable roll; and a transmission connecting said gearwheel to said further adjustable roll, causing said two adjustable rolls to be jointly drivable by said gear rack through said gearwheel.

7. The digital printing machine according to claim 6, wherein said transmission is a bevel gear mechanism including bevel gears.

8. The digital printing machine according to claim 1, wherein said rail is clamped between said adjustable roll and said spring-mounted roll when said printing bar is in said working position.

* * * * *